US006443263B1

(12) United States Patent
Ito et al.

(10) Patent No.: US 6,443,263 B1
(45) Date of Patent: Sep. 3, 2002

(54) OIL TANK FOR AN INTERNAL COMBUSTION ENGINE

(75) Inventors: Katsuhiko Ito; Masataka Eguchi, both of Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 71 days.

(21) Appl. No.: 09/655,337

(22) Filed: Sep. 5, 2000

(30) Foreign Application Priority Data

Sep. 5, 1999 (JP) ..... 11-291413

(51) Int. Cl.[7] ..... F01M 1/04
(52) U.S. Cl. ..... 184/6.5; 123/196 R
(58) Field of Search ..... 184/6.5–6.8, 1.5; 123/196 R

(56) References Cited

U.S. PATENT DOCUMENTS 3,670,499 A * 6/1972 Tucholski ..... 60/54
3,680,312 A * 8/1972 Forster ..... 60/53 A
3,712,420 A * 1/1973 Pelizzoni et al. ..... 184/103 R
3,854,160 A * 12/1974 Hildebrand et al. ..... 15/84
3,937,084 A * 2/1976 May ..... 73/309
4,716,730 A * 1/1988 Hagin et al. ..... 60/456
4,953,547 A * 9/1990 Leboime ..... 180/9.1
5,085,053 A * 2/1992 Hayashi et al. ..... 60/488
5,568,842 A * 10/1996 Otani ..... 184/6.6
5,640,936 A * 6/1997 Hudson ..... 184/1.5
5,669,464 A * 9/1997 Earleson ..... 184/1.5
5,685,396 A * 11/1997 Elkin et al. ..... 184/1.5
5,749,339 A * 5/1998 Graham et al. ..... 123/73 AD
5,755,194 A * 5/1998 Moorman et al. ..... 123/196 W
6,314,934 B1 * 11/2001 Ito et al. ..... 123/196 R
6,318,333 B1 * 11/2001 Narita et al. ..... 123/196 R
6,332,444 B1 * 12/2001 Narita et al. ..... 123/196 R

FOREIGN PATENT DOCUMENTS

JP 4-31915 5/1992

* cited by examiner

*Primary Examiner*—Chong H. Kim
(74) *Attorney, Agent, or Firm*—Birch, Stewart, Kolasch & Birch, LLP

(57) ABSTRACT

An oil tank of large capacity is integrally mounted directly to a front side of a front case cover in a power unit including a hydrostatic type continuously variable transmission. The power unit is driven by a crankshaft within a crankcase, and a lower portion of the oil tank is connected through an inlet and an outlet both formed in the front case cover to an oil pump disposed inside the front case cover in order to dispense with piping and fittings required when a tank is located separately from a power unit.

16 Claims, 4 Drawing Sheets

OIL TANK FOR AN INTERNAL COMBUSTION ENGINE

BACKGROUND OF THE INVENTION

1. Field of the Invention

The present invention relates to an oil tank for use in a lubricating system of a drive sump type internal combustion engine. The oil tank of the present invention is simplified in both structure and in its requirements of manufacture.

2. Background Art

In a drive sump type internal combustion engine, an oil tank is provided separately from an engine and is connected through hoses to a feed pump and a scavenging pump disposed on the side of an engine. For example, in Japanese Published Examined Patent Application No. H4-31915, a conventional oil tank is shown disposed behind an engine and supported separately from the engine by a vehicle body frame.

If an oil tank is disposed separately from an engine as in the conventional art, the oil tank and the engine must be each connected to a vehicle body frame through a mount and a hose. This arrangement results in an increased number of assembling steps and more complicated assembling and mounting methods. If oil is to be fed to a hydrostatic type continuously variable transmission, the oil tank required becomes fairly large in size and the provision of such a large-sized oil tank becomes cumbersome in the layout of a vehicle body.

SUMMARY OF THE INVENTION

The present invention overcomes the shortcomings associated with the prior art and achieves other advantages not realized by the prior art.

Accordingly, it is an object of the present invention to provide an oil tank that is simplified in structure and requires relatively few assembling steps in comparison to the devices of the conventional art.

A further object of the present invention is to provide an oil tank that helps to increase system efficiency by facilitating cooling of lubricants within a lubrication oil system.

A further object of the present invention is to provide an oil tank that reduces power requirements for the pumping of oil within a lubrication system.

A further object of the present invention is to provide an oil tank that can be installed in a position that reduces cumbersome hoses and fittings associated with separately mounted oil tanks of the conventional art.

These and other objects are accomplished by a lubricating system for a power unit comprising an oil tank; at least one oil pan for an internal combustion engine; a feed pump for feeding lubricating oil in the oil tank to a plurality of components in the power unit; at least one scavenging pump for feeding oil which has stayed in the oil pan back to the oil tank; wherein said oil tank for the power unit is mounted directly to a side portion of the power unit; and a hydrostatic type continuously variable transmission, wherein the oil tank feeds oil to the hydrostatic type continuously variable transmission.

These and other objects are also accomplished by a lubricating system for an internal combustion engine comprising an oil tank; at least one oil pan for the internal combustion engine; a feed pump for feeding oil in the oil tank to a plurality of portions in the internal combustion engine to be lubricated; at least one scavenging pump for feeding oil which has stayed in the oil pan back to the oil tank; wherein said oil tank for the internal combustion engine is mounted directly to a side portion of the internal combustion engine via a mounting seat; a bearing portion for housing a bearing of the crankshaft; an inlet in communication with a suction side of the feed pump; an outlet in communication with a discharge side of each scavenging pump, wherein said inlet and said outlet are both formed in a position vertically beneath said bearing portion and in direct communication with a lower portion of the oil tank; a lower portion; an upper portion; a front side portion and a rear side portion; a left side portion and a right side portion; an initial cooling passage extending from said lower portion to said upper portion along said rear side portion, wherein said initial cooling passage is connected to an outlet in communication with the discharge side of each scavenging pump; an upper end portion of the initial cooling passage is in communication with a horizontal passage extending from said rear side portion of the tank to said front side portion of the tank; and a front end of the horizontal passage is formed as a discharge port connected to an oil cooler.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

DETAILED DESCRIPTION OF THE PREFERRED EMBODIMENTS

Figure 1:
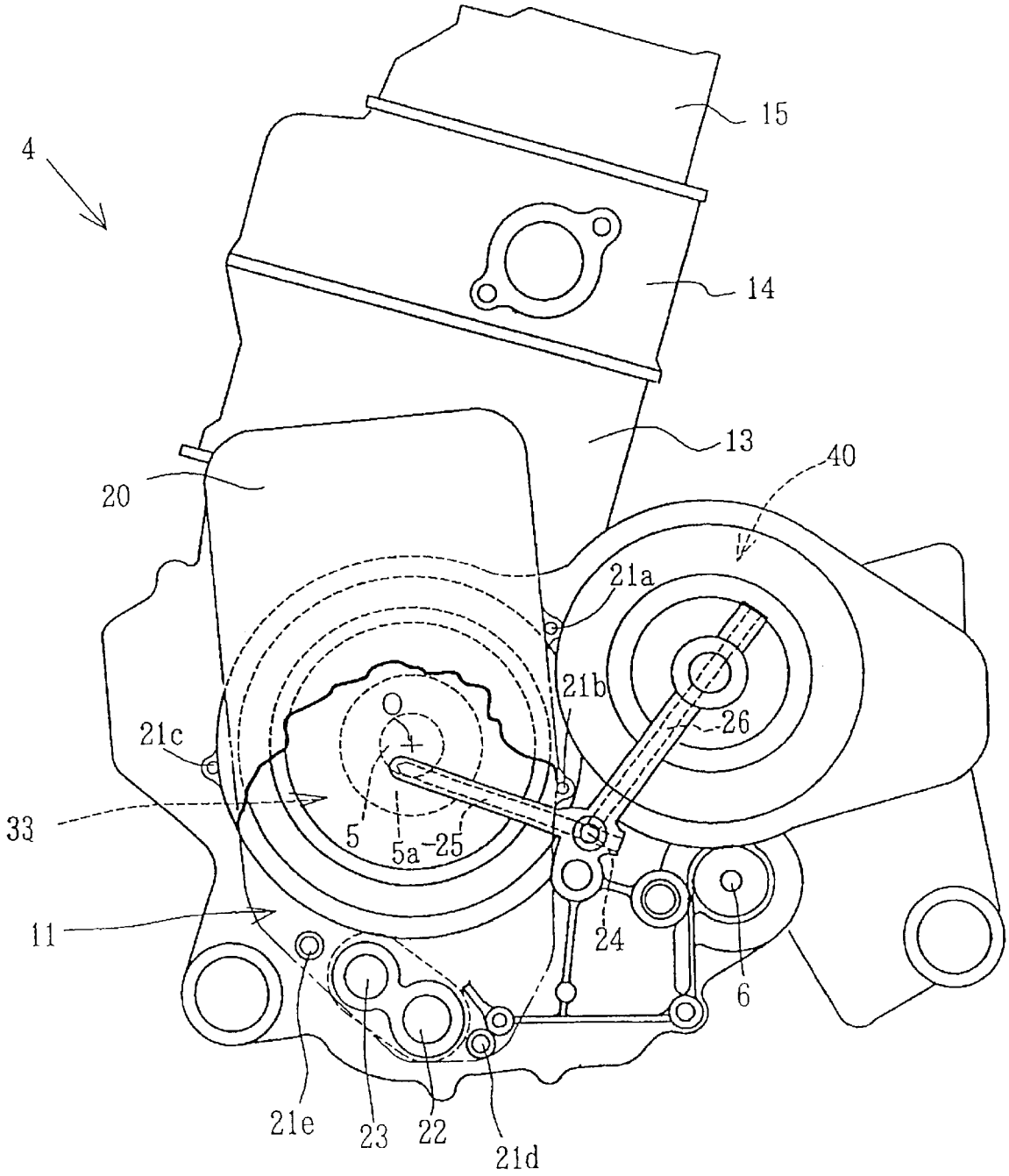
FIG. 1 is a partially cut-away diagram of a power unit related to an embodiment of the present invention, as seen from a front side of a vehicle body.
Figure 2:
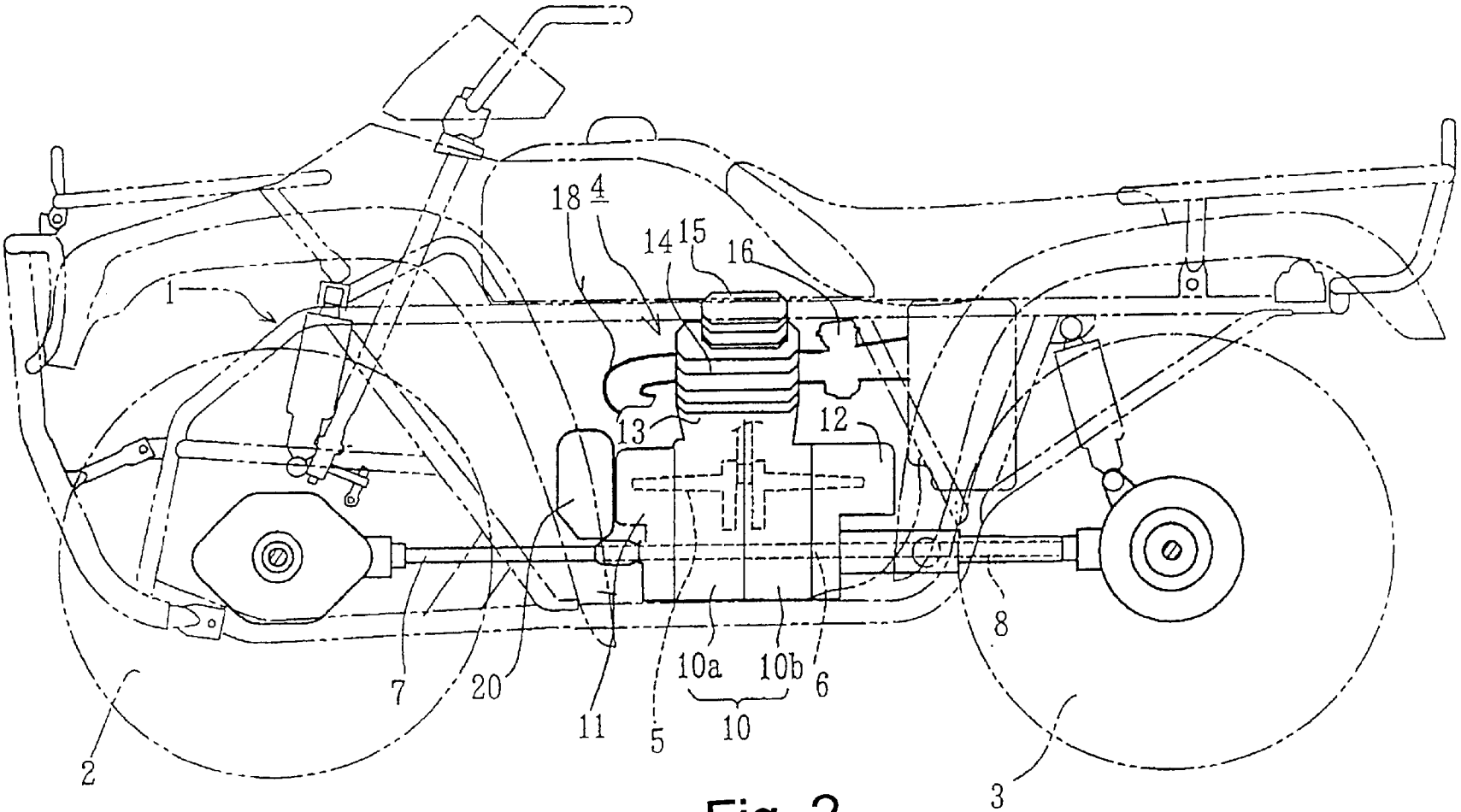
FIG. 2 is a side view of a principal portion of a vehicle body of a four-wheeled buggy to which the embodiment of the invention is applied.
Figure 3:
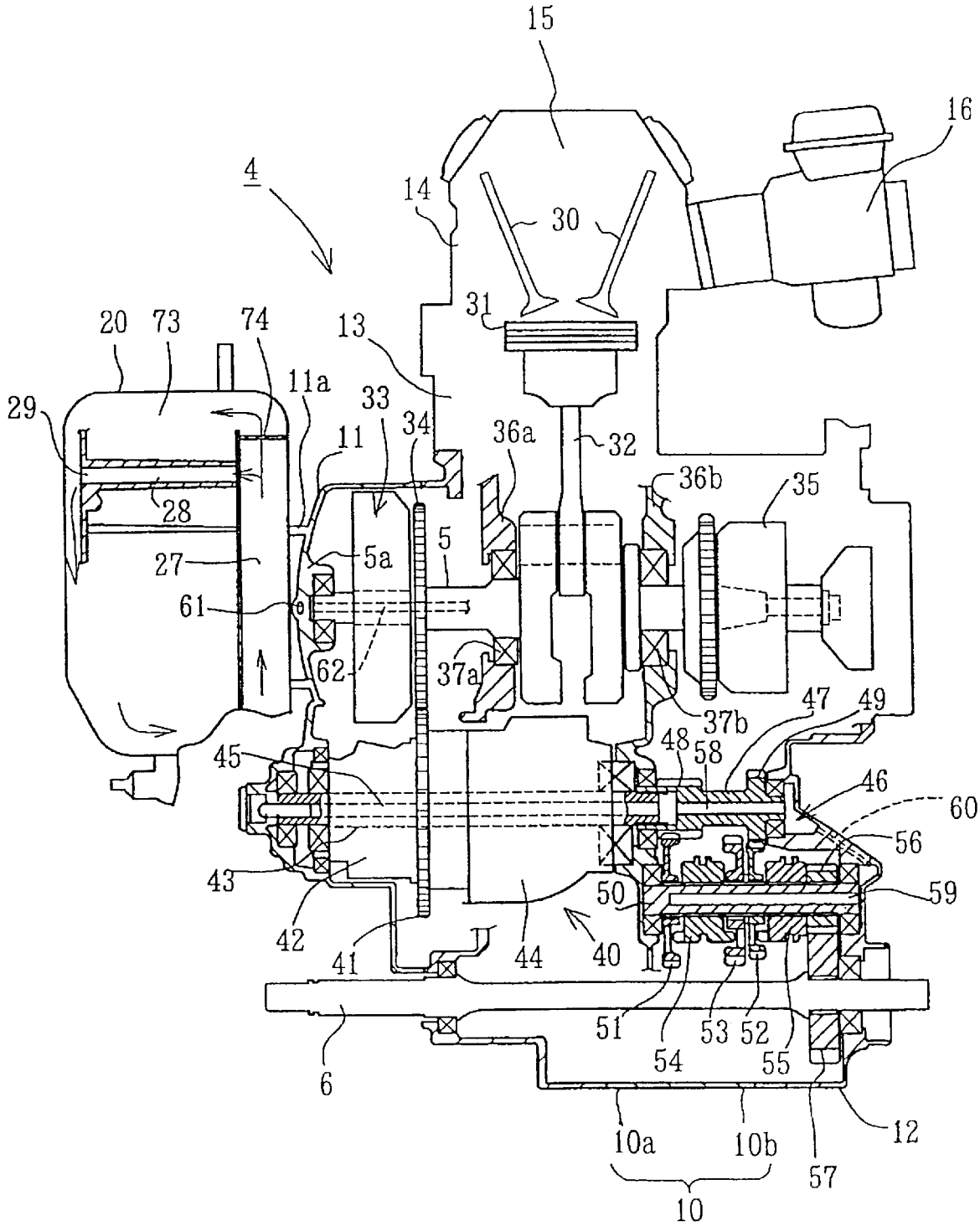
FIG. 3 is a longitudinal sectional view of the power unit.
Figure 4:
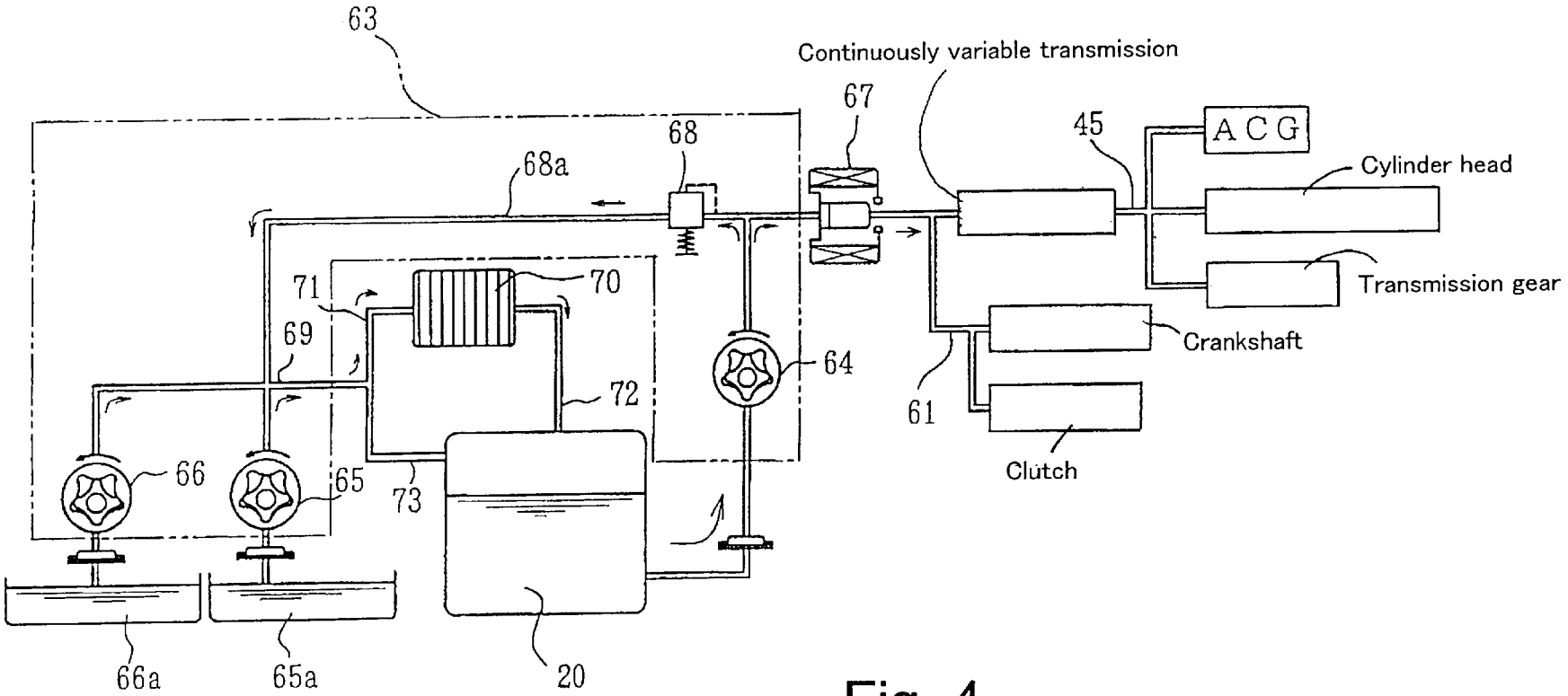
FIG. 4 is a lubricating system diagram.

An embodiment of the present invention applied to a four-wheeled buggy will be described below with reference to the drawings, in which FIG. 1 is a partially cut-away view of a power unit used in the embodiment, as seen from a front side of a vehicle body, FIG. 2 is a side view of a principal portion of the body of the four-wheeled buggy, FIG. 3 is a longitudinal sectional view of the power unit taken along a plane parallel to a crankshaft and a drive shaft of a hydrostatic type continuously variable transmission, and FIG. 4 is a lubricating system diagram.

An entire structure of a four-wheeled buggy will first be outlined with reference to FIG. 2. The four-wheeled buggy is provided with a pair of right and left front wheels 2 and a pair of right and left rear wheels 3, which are disposed in front and rear positions, respectively, of a body frame 1. A power unit 4 is supported centrally by the body frame 1. The power unit 4 is integrally provided with an engine and a transmission. The power unit 4 is a longitudinally installed type wherein a crankshaft 5 is disposed longitudinally with respect to the vehicle body. This four-wheeled buggy is a four-wheel drive type wherein, by means of an output shaft 6 disposed in parallel with the crankshaft 5 in a lower portion of the power unit 4, the front and rear wheels 2, 3 are driven through a front wheel propeller shaft 7 and a rear wheel propeller shaft 8, respectively.

The power unit 4 includes a crankcase 10 that has a front side covered with a front case cover 11 and a rear side covered with a rear case cover 12. These components collectively constitute a power unit case. The crankcase 10 is longitudinally divided into a front case 10*a* and a rear case 10*b*. A cylinder block 13, a cylinder head 14, and a cylinder head cover 15 are mounted to an upper portion of the crankcase 10. A carburetor 16 is connected to an intake port of the cylinder head 14, and an air cleaner 17 is connected to the carburetor 16 from behind the carburetor. An exhaust pipe 18 is connected to an exhaust port of the cylinder head 14.

An oil tank 20 is mounted directly to a front side of the front case cover 11. As shown in FIG. 1, the oil tank 20 is vertically long and has a large capacity. The oil tank is secured to the front case cover 11 at five positions with bolts 21*a*, 21*b*, 21*c*, 21*d*, and 21*e*. Of these bolts, bolts 21*a* and 21*b* are at vertically spaced positions on the same side with respect to a center O of the crankshaft 5. The bolt 21*c* is at a slightly upper position with respect to the center O of the crankshaft on the side opposite to the bolts 21*a* and 21*b*. This oil tank mounting position vertically sandwiches a bearing portion 5*a* of the crankshaft 5 which is provided in the front case cover 11. The bolts 21*d* and 21*e* fulfill their function of clamping the oil tank 20 to the crankcase 10 through an oil passage.

As shown in FIG. 3, a mounting seat 11*a* of the oil tank 20 is integral with the front side of the front case cover 11. An inlet 22 to an oil pump and an outlet 23 from the oil pump are formed in a lower portion of the front case cover 11 and below the crankshaft 5 in a vertically, obliquely offset relationship to each other. The inlet 22 and the outlet 23 are in direct communication with a lower portion of the oil tank 20. An oil pump 63, which is schematically illustrated in the figures, is mounted inside the case cover 11 and is composed of a feed pump and a scavenging pump. The inlet 22 is in communication with a suction side of the feed pump 64, while the outlet 23 is in communication with a discharge side of the scavenging pump(s) 65 and/or 66.

A main oil passage 24 formed inside the front case cover 11 branches into oil passages 25 and 26 in order to provide lubrication to various portions of the engine from the oil pump 63. The oil passage 25 extends toward a starting clutch 33 through the wall of the front case cover 11 and opens near a front end portion of the crankshaft 5. The oil passage 26 extends toward a hydrostatic type continuously variable transmission 40 through the wall of the front case cover 11. The oil passage 26 not only feeds a driving oil to the transmission 40, but also passes through the transmission and feeds oil to various other portions of the engine requiring lubrication.

Within the oil tank 20, an initial cooling passage 27 is defined which is connected to the outlet 23 of the front case cover 11 and which extends vertically. An upper end portion of the cooling passage 27 is in communication with a horizontal passage 28. A front end of the passage 28 is formed as a discharge port 29. A portion of the oil which has been fed from the power unit 4 side partially passes through the passage 28 from the initial cooling passage 27, then is discharged from the discharge port 29 and passes through an oil cooler 70. This oil is then returned to the oil tank 20, while the remaining portion of the oil passes through an orifice 74 and further through a passage 73, where it is then discharged to an upper portion in the oil tank 20.

Oil in the oil tank 20 flows downward through the interior of the tank as it is being cooled, and finally returns to the inlet 22 of the cover case 11. Flow path resistance is optimized or reduced with this arrangement as only a required portion of the system oil passes through the oil cooler 70. The passage 73 to the oil tank 20 is branched from the passage to the oil cooler 70 in order to achieve this desired reduction in flow path resistance potentially caused by passage of all of the oil through the oil cooler 70.

The power unit will now be described in detail with reference to the accompanying figures. A power unit includes a valve 30, a piston 31, a connecting rod 32, a starting clutch 33 in a centrifugal clutch mechanism provided at one end of the crankshaft 5, a primary driving gear 34 adapted to rotate integrally with an outer clutch of the starting clutch, and an ACG 35 disposed on an opposite end side. The crankshaft 5 is carried on main bearings 37*a* and 37*b* in journal walls 36*a* and 36*b* which are integral with a front case 10*a* and a rear case 10*b*, respectively.

The hydrostatic type continuously variable transmission 40 is mounted within the crankcase 10 which includes the engine portion 41 of the power unit 4. A nearly longitudinal half of the transmission 40 overlaps the portion between the main bearings 37*a* and 37*b*. In the hydrostatic continuously variable transmission 40, a primary driven gear 41 meshing with the primary driving gear 34*a* drives a hydraulic pump 42. A hydraulic motor 44 is driven with the oil discharged from the hydraulic pump 42 and provides a speed change output to a driving shaft 43. The hydraulic motor 44 and the hydraulic pump 42 are mounted in a side by side arrangement on the driving shaft 43. The driving shaft 43 is disposed in parallel with the crankshaft 5, thereby providing a crankshaft and driving shaft 43 that are both axially coincident with the longitudinal direction of the vehicle body.

An oil passage 45 is formed longitudinally through the axis of the driving shaft 43. The primary driving gear 34 and the hydrostatic type continuously variable transmission 40 constitute a primary reduction means. One end of the driving shaft 43 is directly splined to a main shaft 47 of a step transmission 46. A low speed range driving gear 48 and a second speed range driving gear 49 are integrally mounted on the main shaft 47. Both gears are in mesh with a low speed range driven gear 51 and a second speed range driven gear 52, respectively, which are adapted to rotate on a counter shaft 50 parallel to the main shaft 47. Also mounted rotatably on the counter shaft 50 is a reverse driven gear 53 which is rotated in a direction opposite to the driven gears 51 and 52 by means of a reverse idle gear meshing with the driving gear 48 on a separate shaft, though not shown.

Shifters 54 and 55 are splined to the counter shaft 50 so as to be axially movable. As seen in FIG. 3, when the shifter 54 is moved leftwards, the rotation of the low speed range driven gear 51 is transmitted from the counter shaft 50 to a final driving gear 56 which is integral with an end portion of the counter shaft, and is further transmitted to the output shaft 6 through a final driven gear 57 mounted on the output shaft and meshing with the final driving gear 56. The rotation of the second speed range driven gear 52 is also transmitted to the output shaft 6 when the shifter 55 is moved to the left in order to drive the vehicle in the second speed range.

In contrast, when the shifter 54 is moved to the right, the rotation of the reverse driven gear 53 is transmitted to the counter shaft 50 to rotate the counter shaft reverse, whereby the output shaft 6 is rotated in a reverse direction of rotation in order to drive the vehicle backward. The step transmission 46, the final driving gear 56, and the final driven gear 57 constitute a secondary reduction means.

An oil passage 58 communicating with the oil passage 45 formed in the driving shaft 43 is formed through the axis of the main shaft 47, and an oil passage 59 is also formed axially within the counter shaft 50. However, the oil passage 59 is closed on its inner side (unlike passage 58) and is open on its outer side, wherein the open end faces an oil passage 60 formed in the wall of the rear case cover 12 and is supplied with oil which has passed through the main shaft 47. Further, through an oil passage formed in the rear case cover 12 separately from the oil passage 60, oil is also fed for lubrication to the ACG 35 and to a valve operating mechanism in the cylinder head 14. Also, an oil passage 62 is formed axially within the crankshaft 5 so as to supply oil from an oil passage 61 formed in the front case cover 11 to the starting clutch 33 and the bearings for the crankshaft 5.

FIG. 4 illustrates an oil feed system in which an oil pump 63 is made up of one feed pump 64, a main scavenging pump 65 and a sub-scavenging pump 66. The feed pump 64 sucks in oil from the oil tank 20 and discharges the oil to an oil filter 67. Oil is then fed to the oil passage 45 formed in the driving shaft 43 of the hydrostatic continuously variable transmission 40 and to the oil passage 62 formed in the crankshaft 5 via oil passage 61.

Part of the oil fed to the oil passage 45 functions as both driving oil and lubricating oil for the hydrostatic continuously variable transmission 40. The remaining portion of the oil, as noted earlier, is fed to and lubricates various portions of the engine, including: the ACG 35, the valve operating mechanism for the valve 30 in the cylinder head 14, and the secondary reduction means, including the step transmission 46, using the oil passage 45 as lubricating oil passages for these other various portions. The oil fed to the oil passage 61 lubricates the crankshaft 5 and the starting clutch 33. The discharge passage of the feed pump 64 is also in communication with a relief passage 68a through a relief valve 68 so that when the discharge pressure has exceeded a predetermined value, the excess pressure is allowed to escape to the relief passage 68*a*.

The main scavenging pump 65 and the sub-scavenging pump 66 suck up oil staying in oil sumps 65*a* and 66*a*. Each oil sump is made up of the bottom of the crankcase 10 and an oil pan or the like and is separated from one another. The scavenging pumps discharge the thus-sucked oil to a joined discharge passage 69, in which the oil is combined with the oil fed from the relief passage 68*a*. Oil in the joined discharge passage 69 is then fed through a return hose 71 to an oil cooler 70 installed at an appropriate position of the vehicle body. The oil which has been cooled in the oil cooler 70 again returns to the oil tank 20 through a return hose 72.

The operation of an embodiment of the present invention will now be described with reference to the accompanying figures. Since the oil tank 20 is mounted directly to the front case cover 11, it is not necessary to support the oil tank separately with respect to the vehicle body frame or to connect it to the engine through an oil hose. Consequently, the mounting of the oil tank becomes easier and the number of assembling steps can be decreased. Furthermore, by omitting the use of a heavy and expensive hose, it is possible to attain further reductions in weight and cost.

Moreover, since an oil tank mounting seat can be formed integrally with part of the front case cover 11, even if an oil tank 20 large in capacity is required for feeding a large amount of driving oil to the hydrostatic type continuously variable transmission 40, it is possible to ensure an easy mounting place for the oil tank 20. This arrangement further facilitates a simplified layout of the vehicle body.

Further, by mounting the oil tank 20 on the front side of the power unit 4, it is possible to expect an improvement in cooling efficiency. Since air passing into the vehicle's front portion is increased substantially during vehicle operation, the oil in the tank of the present invention is efficiently cooled by wind/air which is induced during vehicular running. Likewise, by mounting an oil tank 20 of a large capacity integrally to a side face of the power unit case it is possible to attain a higher concentration of mass and thereby lower the center of gravity of the vehicle body. Since the bolts 21*a* and 21*b* for mounting the oil tank 20 are disposed in upper and lower positions, respectively with respect to the crankshaft 5, even if the relatively heavy oil tank 20 is supported by the front case cover 11, the crankshaft 5, which is also supported by the front case cover 11 though bearings, is reliably secured as it becomes difficult to undergo deviation relative to the bearings with this counterweighted arrangement.

Further, since the oil tank 20 is connected at its lower portion to the inlet 22 and outlet 23 of the front case cover 11, it is possible to concentrate required connections and to reduce the amount of effort required in component assembly.

The cooling efficiency can be further improved by the present invention. The high temperature oil which has been fed from the power unit 4 side into the oil tank 20 through the outlet 23 by the scavenging pump 65 is first cooled to a certain extent while moving upward through the initial cooling passage 27. It is cooled sufficiently thereafter while being discharged from the discharge port 29 to the upper portion in the oil tank 20 and dropping toward the bottom of the tank.

Furthermore, the mounting position of the oil tank 20 is not limited to the front side of the engine, but may be a side face or rear side of the engine. An intra-tank discharge port of oil flowing back from the scavenging pump may be formed in the upper portion of the oil tank 20, an outlet to the feed pump may be formed separately in the lower portion of the oil tank, and/or both may be brought into communication with the oil pump disposed within the crankcase 10.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A power unit having an internal combustion engine, a side portion, a plurality of components, a hydrostatic continuously variable transmission, and a lubricating system, said power unit and lubricating system comprising:

an oil tank;

at least one oil pan for the internal combustion engine;

a feed pump for feeding lubricating oil in the oil tank to the plurality of components in the power unit;

at least one scavenging pump for feeding oil which has stayed in the oil pan back to the oil tank; wherein said oil tank for the power unit is mounted directly to the side portion of the power unit;

an initial cooling passage extending from a lower portion of said oil tank to an upper portion of said tank along a rear side portion of said tank, wherein said initial cooling passage is connected to an outlet in communication with a discharge side of each scavenging pump;

an upper end portion of the initial cooling passage is in communication with a horizontal passage extending from said rear side portion of the tank to said front side portion of the tank; and a front end of the horizontal passage is formed as a discharge port connected to an oil cooler.

2. The power unit and lubrication system according to claim 1 wherein the oil tank feeds oil to the hydrostatic continuously variable transmission.

3. The power unit and lubrication system according to claim 1, further comprising at least a front side portion, a rear side portion, a right side portion, a left side portion, and a bottom portion with respect to a longitudinal axis extending through a crankshaft of the engine, wherein the oil tank is mounted directly to the front side portion of the power unit and each oil pan is mounted directly to the bottom portion of the power unit.

4. The power unit and lubrication system according to claim 3, wherein the oil tank feeds oil to the hydrostatic continuously variable transmission.

5. The power unit and lubrication system according to claim 3, wherein the oil tank is mounted directly to the front side portion of the power unit through a mounting seat integral with the power unit.

6. The power unit and lubrication system according to claim 3, further comprising:

a crankcase including a front side and a rear side, wherein the front side of the crankcase is covered with a front side cover and the rear side of the crankcase is covered with a rear side cover, wherein the oil tank is mounted directly to the front side cover of the power unit through a mounting seat integral with front side cover.

7. The power unit and lubrication system according to claim 6, further comprising:

a bearing portion for housing a bearing of the crankshaft;

an inlet in communication with a suction side of the feed pump;

an outlet in communication with a discharge side of each scavenging pump, wherein said inlet and said outlet are both formed in a position vertically beneath said bearing portion and in direct communication with a lower portion of the oil tank.

8. A power unit having an internal combustion engine, a side portion, a plurality of components, and a lubricating system, said power unit and lubricating system comprising:

an oil tank;

at least one oil pan for the internal combustion engine;

a feed pump for feeding lubricating oil in the oil tank to the plurality of components in the power unit; and at least one scavenging pump for feeding oil which has stayed in the oil pan back to the oil tank; wherein said oil tank for the power unit is mounted directly to the side portion of the power unit, wherein said oil tank further includes a lower portion;

an upper portion;

a front side portion and a rear side portion;

a left side portion and a right side portion;

an initial cooling passage extending from said lower portion to said upper portion along said rear side portion, wherein said initial cooling passage is connected to an outlet in communication with the discharge side of each scavenging pump;

an upper end portion of the initial cooling passage is in communication with a horizontal passage extending from said rear side portion of the tank to said front side portion of the tank; and a front end of the horizontal passage is formed as a discharge port connected to an oil cooler.

9. The power unit and lubrication system according to claim 8, said oil tank further comprising:

an orifice located at an upper end of the initial cooling passage, wherein oil passing through said initial cooling passage is capable of passing through either said horizontal passage or said orifice.

10. The power unit and lubrication system according to claim 9, wherein oil passing through said orifice passes through an upper horizontal passage which is then discharged to an upper portion of the tank.

11. The power unit and lubrication system according to claim 1, wherein oil in the oil tank flows downward along an interior of the tank as it is being cooled until it returns to an inlet in communication with a suction side of said feed pump.

12. A lubricating system for an internal combustion engine and a hydrostatic continuously variable transmission comprising:

an oil tank;

at least one oil pan for the internal combustion engine;

a feed pump for feeding oil in the oil tank to a plurality of portions in the internal combustion engine and the hydrostatic continuously variable transmission to be lubricated;

at least one scavenging pump for feeding oil which has stayed in the oil pan back to the oil tank; wherein said oil tank for the internal combustion engine is mounted directly to a side portion of the internal combustion engine via a mounting seat;

a bearing portion for housing a bearing of the crankshaft;

an inlet in communication with a suction side of the feed pump;

an outlet in communication with a discharge side of each scavenging pump, wherein said inlet and said outlet are both formed in a position vertically beneath said bearing portion and in direct communication with a lower portion of the oil tank;

an initial cooling passage extending from a lower portion of said oil tank to an upper portion of said tank along a rear side portion of said tank, wherein said initial cooling passage is connected to an outlet in communication with a discharge side of each scavenging pump;

an upper end portion of the initial cooling passage is in communication with a horizontal passage extending from said rear side portion of the tank to said front side portion of the tank; and a front end of the horizontal passage is formed as a discharge port connected to an oil cooler.

13. A lubricating system for an internal combustion engine, said lubricating system comprising:

an oil tank, said oil tank including a lower portion, an upper portion, a front side portion, a rear side portion, a left side portion and a right side portion;

at least one oil pan for the internal combustion engine;

a feed pump for feeding oil in the oil tank to a plurality of portions to be lubricated;

at least one scavenging pump for feeding oil which has stayed in the oil pan back to the oil tank;

means for mounting said oil tank directly to a side portion of the internal combustion engine;

an inlet in communication with a suction side of the feed pump; and an outlet in communication with a discharge side of each scavenging pump, wherein said inlet and said outlet are both formed in a position in direct communication with a lower portion of the oil tank;

an initial cooling passage of said oil tank extending from said lower portion to said upper portion along said rear side portion, wherein said initial cooling passage is connected to an outlet in communication with the discharge side of each scavenging pump;

an upper end portion of the initial cooling passage is in communication with a horizontal passage extending from said rear side portion of the tank to said front side portion of the tank; and a front end of the horizontal passage is formed as a discharge port connected to an oil cooler.

14. The lubricating system according to claim 13, said oil tank further comprising:

an orifice located at an upper end of the initial cooling passage, wherein oil passing through said initial cooling passage is capable of passing through either said horizontal passage or said orifice.

15. The lubricating system according to claim 14, wherein oil passing through said orifice passes through an upper horizontal passage which is then discharged to an upper portion of the tank.

16. The lubricating system according to claim 15, wherein oil in the oil tank flows downward along an interior of the tank as it is being cooled until it returns to an inlet in communication with a suction side of said feed pump.

* * * * *